United States Patent [19]

Cooper

[11] 4,437,716

[45] Mar. 20, 1984

[54] ELECTRIFIED WALL PANEL SYSTEM

[75] Inventor: Gordon J. Cooper, Alto, Mich.

[73] Assignee: Westinghouse Electric Corp., Pittsburgh, Pa.

[21] Appl. No.: 350,525

[22] Filed: Feb. 19, 1982

[51] Int. Cl.[3] ..... H01R 39/00

[52] U.S. Cl. ..... 339/4; 339/8 R

[58] Field of Search ..... 52/221; 339/4, 6 RA, 339/8 RA, 8 P, 8 PB, 23

[56] References Cited

U.S. PATENT DOCUMENTS

| | | | |
|---|---|---|---|
| 3,808,577 | 4/1974 | Mathauser | 339/8 P X |
| 3,841,042 | 10/1974 | Siegal | 52/239 |
| 4,060,294 | 11/1977 | Haworth et al. | 339/4 |
| 4,097,918 | 6/1978 | Anderson et al. | 362/147 |
| 4,135,775 | 1/1979 | Driscoll | 339/22 R |
| 4,231,630 | 11/1980 | Propst et al. | 339/22 R |
| 4,270,020 | 5/1981 | Kenworthy et al. | 174/48 |
| 4,278,834 | 7/1981 | Boundy | 174/48 |

OTHER PUBLICATIONS

"The Power and Communications Distribution System", Westinghouse ASD Group, Brochure 68-252n, 1977.

*Primary Examiner*—Eugene F. Desmond
*Attorney, Agent, or Firm*—B. R. Studebaker

[57] ABSTRACT

A power distribution system for an open office, space dividing, wall panel system wherein electrical power is transferred from one space dividing wall panel to another through a connecting post cap. Each panel includes a terminal block at each upper corner having an outwardly projecting, arcuate contact carrying tongue, which arcuate contacts may be electrically connected to the arcuate contacts of an adjacent panel through complementary ring contacts on the underside of a cylindrical connecting cap.

7 Claims, 4 Drawing Figures

ELECTRIFIED WALL PANEL SYSTEM

BACKGROUND OF THE INVENTION

Over the past several years there has been a dramatic increase in the use of the open office plan system where movable space dividing wall panels are employed to subdivide an open office area into a plurality of work stations. More recently, efforts have been directed to electrifying these space dividing wall panel systems to make them less dependent on fixed electrical outlets in the floor of the office space intended to be subdivided. Several systems have been utilized to electrically interconnect space dividing wall panel systems. Such systems are disclosed in U.S. Pat. Nos. 3,841,042; 4,060,294; and 4,135,775; as well as U.S. Pat. No. 4,278,834 by Bruce K. Boundy for "Versatile, Electrified, Space Dividing Wall Panel System". In each of these systems a flexible cable or a hinged connector each employing a plug-in system is utilized to transfer electricity from one panel to an adjacent panel.

SUMMARY OF THE INVENTION

This invention relates to a power distribution system for an electrified, open office, space dividing wall panel system and more particularly to a positive electrical interconnection of space dividing wall panels through their support posts without resorting to electrical plug-in systems.

The power distribution system of this invention for a space dividing wall panel system includes at least a pair of planar space dividing wall panels having substantially vertical side edges. Each of the panels includes a terminal block at each upper corner thereof and a wireway adjacent the top edge of each of the panels interconnecting the terminal blocks. A tongue member, having arcuate slots therein extends outwardly from the panel side edges from each of the terminal blocks and each of the arcuate slots have electrical contacts therein with the electrical contacts in the arcuate slots of one terminal block of a panel being electrically connected to the other terminal block of that panel through the wireway along the top edge of the panel.

Mechanical connector means structurally connects and supports the two planar panels thereby situating the arcuate slots of one of the panels adjacent the arcuate slots of the other of the panels. A threadable cap, including a cylindrical cap portion and a threaded stud portion has a plurality of concentric ring contacts on the underside of the cylindrical cap portion mateable with the contacts in the arcuate slots to thereby electrically interconnect the panels when the threaded stud portion is threaded into the mechanical connector means. The contacts in the arcuate slots are disposed on a side wall of the slot, and the cylindrical cap portion includes a plurality of concentric non-conducting ring structures mateable with the arcuate slots and carrying the concentric ring contacts on a side wall of the non-conducting ring structures to thereby mate the conducting ring contacts and the contacts on the arcuate side walls.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
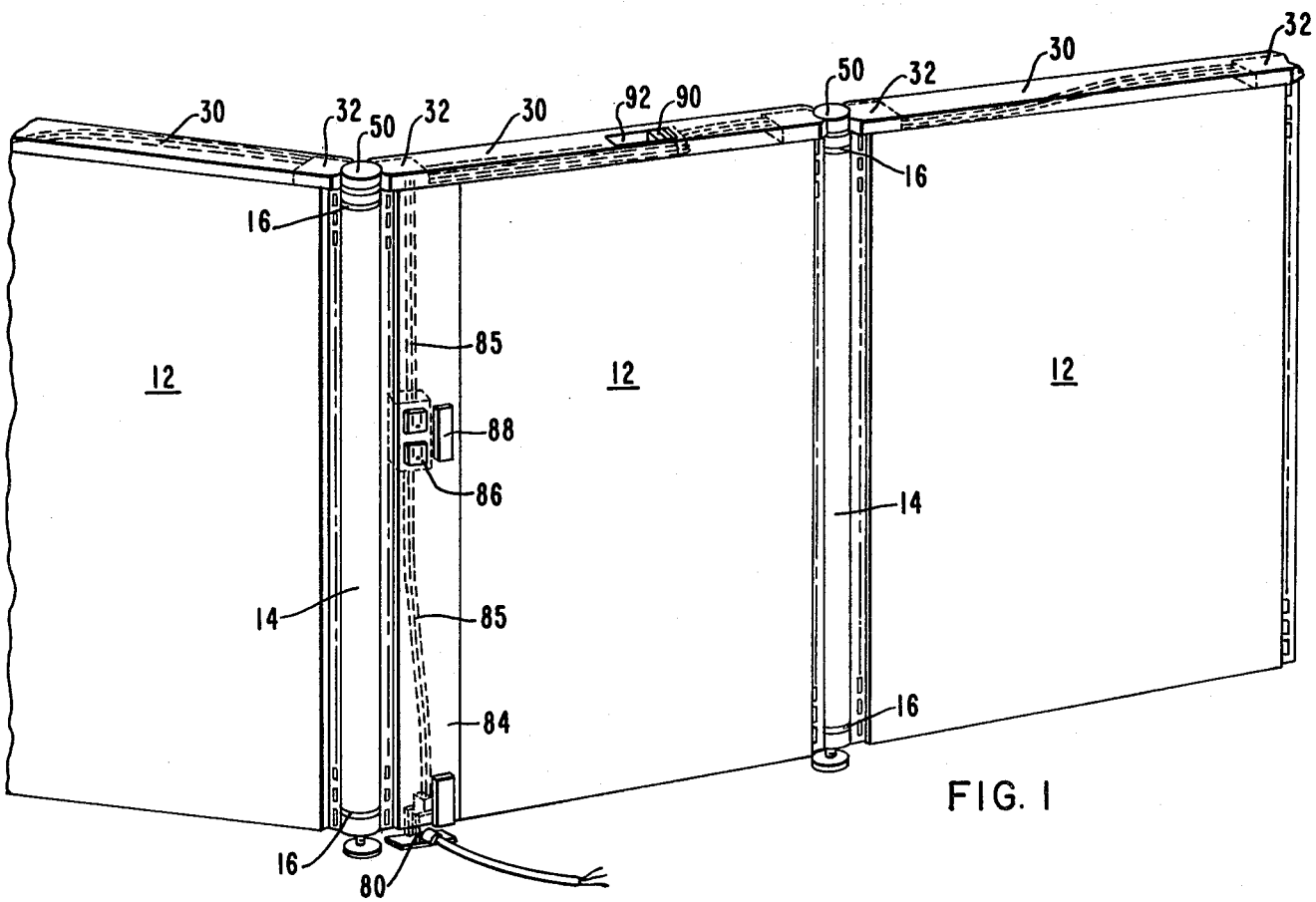
FIG. 1 is an isometric view of the electrified space dividing wall panel system of this invention with a floor feed.
Figure 2:
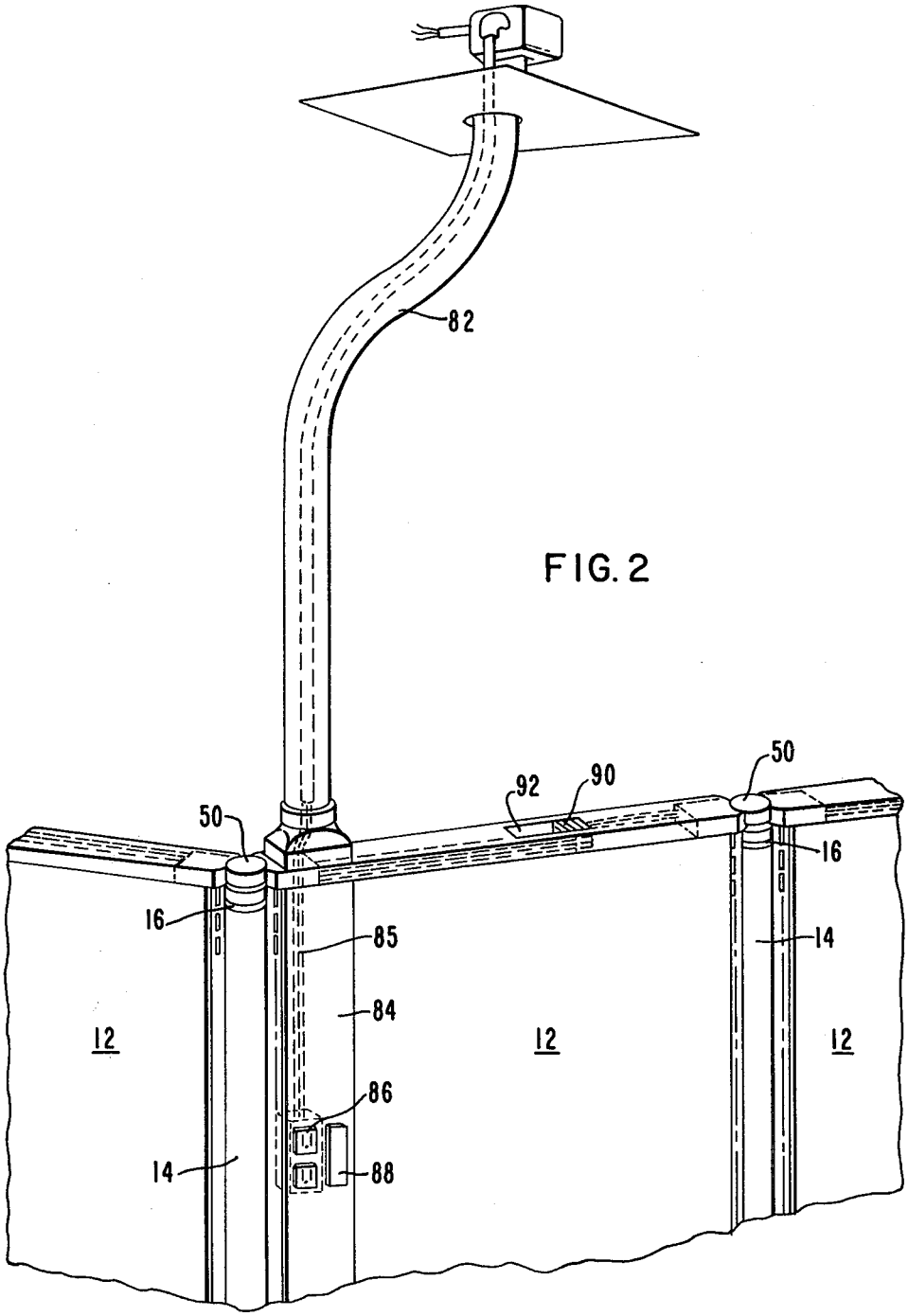
FIG. 2 is a partial isometric view, similar to FIG. 1, illustrating a ceiling feed.

Referring now in detail to the drawing wherein like reference characters represent like parts throughout the several views, there is illustrated in FIGS. 1 and 2 a modified, electrified version of the space dividing wall panel system disclosed in U.S. Pat. No. 3,877,191 issued Apr. 15, 1975 to R. J. Munsey for "Connector Assembly And Support Post". As illustrated in FIGS. 1 and 2 a plurality of space dividing wall panels 12 are interconnected and supported by interposed cylindrical support posts 14. As is well known in the art the panels 12 carry hooked shaped connectors 20 on their vertical edges adjacent the top and bottom of the panels which extend into and are retained by annular slots 16 in the tubular support post.

Figure 3:
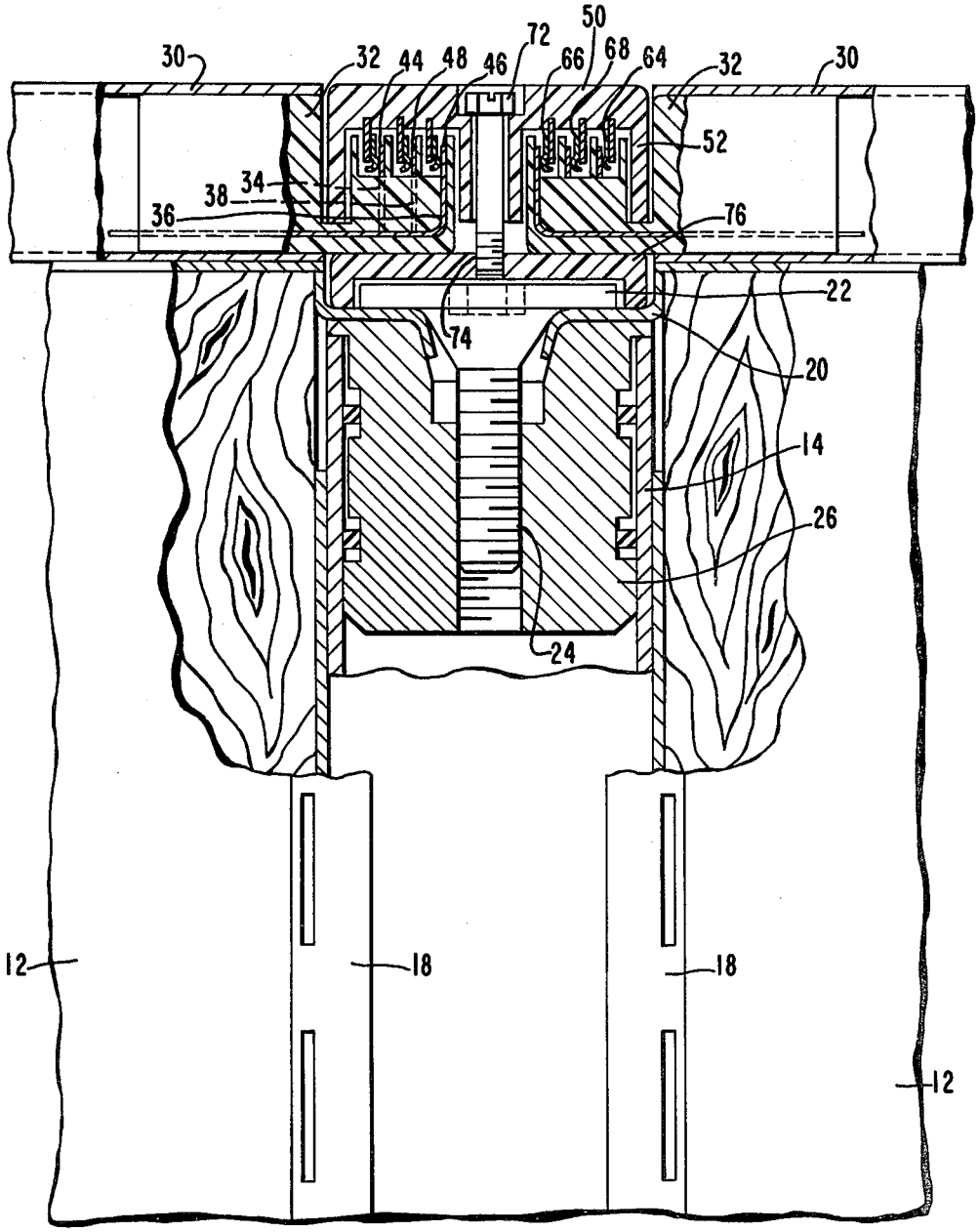
FIG. 3 is a side elevational view, partly in section, of the electrical interconnection of this invention.
Figure 4:
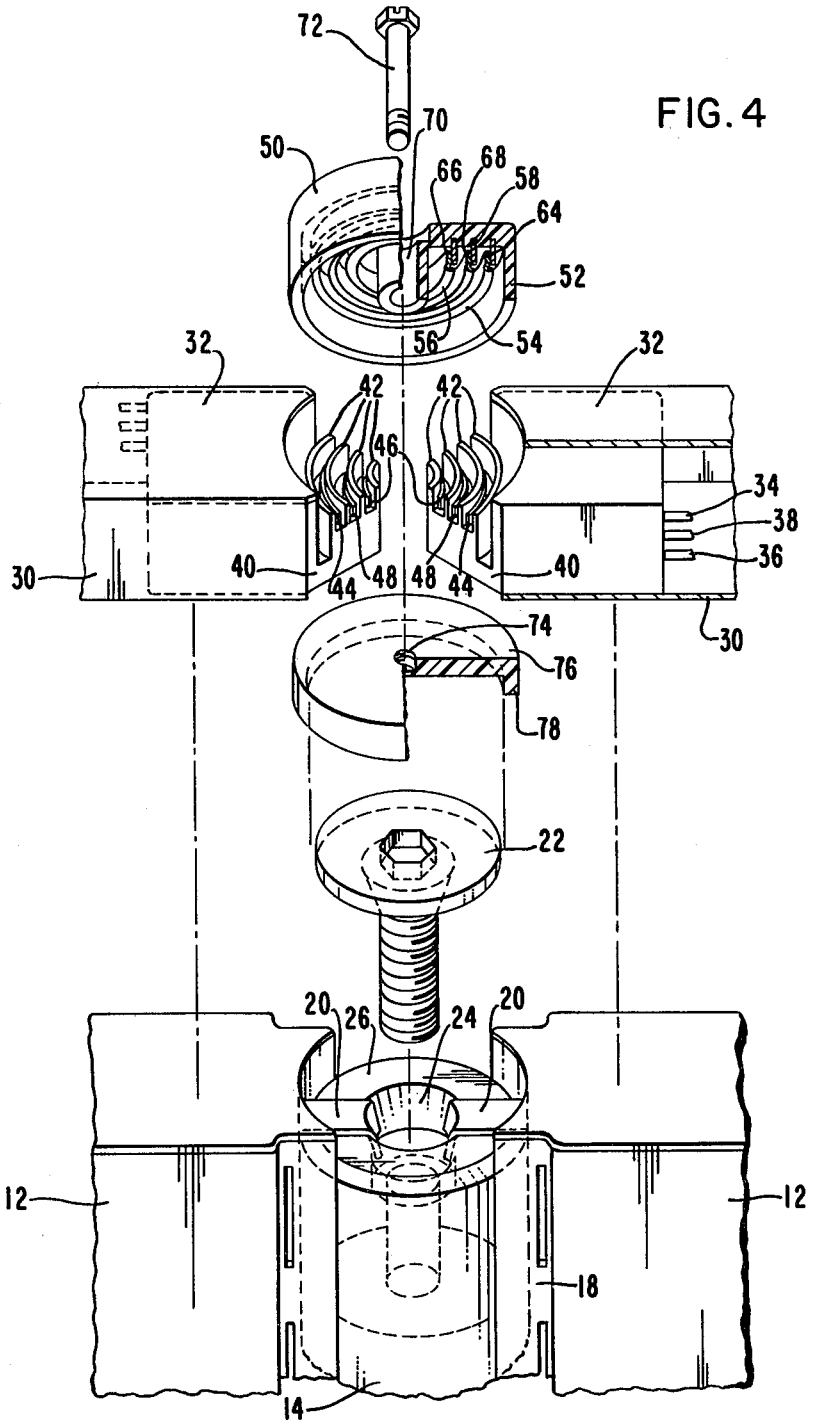
FIG. 4 is an exploded view of the panel electrical interconnection system of FIG. 3.

Referring more particularly to FIGS. 3 and 4 the panels 12 carry a slotted standard 18 on their vertical side edges which include the hooked shaped connectors 20 which extend therefrom. To mechanically interconnect the post and the panels a threaded top cap 22 threads into an aperture 24 in the plug 26 at the top end of the post 14 and the hooked shaped connector 20 at the bottom of the panel hooks into the annular slot 16 at the bottom of the post in the same fashion as disclosed in the aforementioned U.S. Pat. No. 3,877,191.

Most prior art electrical systems have carried their communications and electrical wiring in the base of the panel and have employed jumper cables having male and female plug members at each end, or hinged connectors to transfer electrical power from one panel to the next. In accordance with the present invention, a wireway 30 is secured to the upper edge of the panel in any convenient fashion, as for example, screws or the like and includes at each end a terminal block 32. The terminal blocks at each end of the panel are interconnected by a three wire system which includes a hot wire 34 a neutral wire 36 and a ground wire 38. Each of the terminal blocks 32 have an extension or tongue member 40 extending outwardly therefrom away from the edge of the panel and include at least four arcuate upright members 42 on the upper surface thereof. As best illustrated in FIGS. 3 and 4 three of the arcuate upright members 42 have an electrical contact 44, 46 or 48, on their inner surfaces which are respectively interconnected with the electrical wires 34, 36 and 38.

A cylindrical connecting and conducting cap 50 is employed to interconnect the electrical circuitry of one panel to the electrical circuitry of the adjacent panel. The electrical connecting cap 50 includes a skirt portion 52 which surrounds three concentric annular insulating rings 54, 56 and 58 which carry on their inner surfaces and end edge annular electrical conductors 64, 66 and 68, respectively. These annular electrical conductors 64, 66 and 68 are constructed and arranged, when the electrical connecting cap is in its operative condition, to interconnect the electrical conductors or wires 34, 36 and 38 of adjacent panels through contact with the electrical contacts 44, 46 and 48 of each of the adjacent panels. The electrical connector cap 50 includes an aperture 70 therethrough through which a locking bolt 72 extends and is threaded into a threaded aperture 74 in the cap cover 76. The cap cover 76 is an annular disk having a skirt portion 78 which surrounds the top of the structural support cap 22 and when the bolt 72 is threaded into the cap cover 76 the electrical contacts between the respective conductors is maintained by the sandwiched condition of the conductors between the electrical conducting cap 50 and the cap cover 76.

As illustrated in FIGS. 1 and 2 power can be supplied to the electrified space dividing wall panel system either from a building system where the power lines are in the floor through a 90° box fitting 80 or from a system wherein the power is distributed from the ceiling plenum by means of either a straightline ceiling in-feed or by means of the flexible hose in-feed illustrated at 82. If the power is from the ceiling, it can be delivered directly to one of the terminal blocks 32 at the upper corner of a space dividing wall panel or to a vertical power distribution channel 84. As will be readily apparent from FIG. 1, if the end feed is from the floor of the space, a vertical power distribution channel 84 is necessary to get power to a terminal block at the upper edge of the panel through electrical conductors 85. As will be apparent, since the overall width of the panel 12 from slotted standard to slotted standard must be consistent, the panel portion of the panel with a power distribution channel 84 at one end must be slightly shorter to accommodate the vertical power distribution channel. The use of vertical power distribution channels at the side edge of selected panels further provides the facility for locating convenience outlets 86 or telephone communications outlets 88 at desk level. The conventional outlets 86 can be electrified by the electrical conductors 85.

Another distinct advantage of providing the wire way 30 at the upper edge of the space dividing wall panel is that it permits the inclusion along the top edge of the panel of a conventional convenience outlet 90 which may be located in opening 92 in the wire way top wall. The convenience outlet 90 in the top edge of the panel allows for the ready adaptation of wall mounted lighting or sound systems as for example and lighting system disclosed in U.S. Pat. No. 4,097,918 issued June 27, 1978 to W. C. Anderson et al for Illuminated Space Dividing Wall Panel System.

Although only two panels are illustrated as being connected to a single post 14, it will be apparent that up to four panels can be supported by a single post and regardless of the angular relationship of any two panels electrical power will be transmitted from one panel to the other through the versatile ring contact carrying cap 50.

It should be further understood that more than a single electrical circuit could be interconnected from panel to panel with the inclusion of additional arcuate slots and associated contacts on the tongue member 40 and additional complementary ring contacts on the underside of connecting cap 50.

What is claimed is:

1. A power distribution system for an electrified, open office, space dividing wall panel system, said power distribution system comprising:

at least two planar space dividing wall panels having substantially vertical side edges, each of said space dividing wall panels including a terminal block adjacent each upper corner thereof and a wireway adjacent the top edge of each of said panels interconnecting said terminal blocks;

an extension member extending outwardly of said panel from said terminal blocks having at least three arcuate electrical contacts thereon;

a support post mechanically interconnecting and supporting said at least two planar panels; and a cylindrical conducting cap having at least three concentric ring contacts on the underside thereof constructed and arranged to coact with said at least three electrical contacts on adjacent extension members to transfer electrical power from one space dividing wall panel to an adjacent space dividing wall panel.

2. The power distribution system according to claim 1 wherein the underside of said cylindrical cap includes a plurality of concentric non-conducting ring structures supporting said concentric ring contacts on a sidewall thereof.

3. The power distribution system according to claim 1 wherein an aperture is provided in the upper surface of said wireway and an electrical convenience outlet is interposed between said terminal blocks.

4. The power distribution system according to claim 1 wherein at least one of said space dividing wall panels includes a vertical power distribution channel along one vertical edge thereof and an electrical convenience outlet is located intermediate the top and bottom ends of said vertical power distribution channel.

5. A power distribution system for an electrified, open office, space dividing, wall panel system; said power distribution system comprising:

at least two planar space dividing wall panels having substantially vertical side edges, each of said space dividing wall panels including a terminal block adjacent each upper corner thereof and a wireway adjacent the top edge of each of said panels interconnecting said terminal blocks;

a tongue member, having arcuate slots therein extending outwardly of said panel side edges from each of said terminal blocks, said arcuate slots each having an electrical contact on a side wall thereof with said electrical contacts in the arcuate slots of one terminal block of a panel being electrically connected to the other end of the panel through said wireway;

mechanical connector means for structurally connecting and supporting said at least two planar panels thereby situating said arcuate slots of one of said panels adjacent the arcuate slots of the other of said panels; and cap means, including a cylindrical cap portion, said cylindrical cap portion including a plurality of concentric non-conducting ring structures each having a ring contact disposed on a side wall thereof, each of said ring contacts mateable with the contacts in said arcuate slots of said at least two planar panels to thereby electrically interconnect said panels.

6. The power distribution system according to claim 5 wherein an aperture is provided in the upper surface of said wireway and an electrical convenience outlet is interposed between said terminal blocks.

7. The power distribution system according to claim 5 wherein at least one of said space dividing wall panels includes a vertical power distribution channel along one vertical edge thereof and an electrical convenience outlet is located intermediate the top and bottom ends of said vertical power distribution channel.

* * * * *